United States Patent [19]

Hensley

[11] Patent Number: 4,699,045

[45] Date of Patent: Oct. 13, 1987

[54] HOUSING FOR FOUNDATION VENTILATOR

[75] Inventor: Robert C. Hensley, Iron Station, N.C.

[73] Assignee: Temp-Vent Corporation, Shelby, N.C.

[21] Appl. No.: 899,999

[22] Filed: Aug. 25, 1986

[51] Int. Cl.[4] ..... F24F 13/15

[52] U.S. Cl. ..... 98/37; 98/114; 236/49

[58] Field of Search ..... 98/1, 29, 114, 41.3, 98/37; 236/49

[56] References Cited

U.S. PATENT DOCUMENTS

| | | | |
|---|---|---|---|
| 1,979,543 | 11/1934 | Heasley | 98/114 |
| 2,679,796 | 6/1954 | Froelich et al. | 98/114 |
| 2,722,170 | 11/1955 | Broberg | 98/114 |
| 3,220,079 | 11/1965 | Aggson | 98/37 |
| 3,528,606 | 9/1970 | Witten | 98/114 |
| 4,175,480 | 11/1979 | Beam, Jr. et al. | 98/37 |
| 4,208,010 | 6/1980 | Beam, Jr. et al. | 98/114 X |
| 4,231,514 | 11/1980 | McSwain | 236/49 |
| 4,274,330 | 6/1981 | Witten et al. | 98/29 X |
| 4,290,554 | 9/1981 | Hensley | 98/29 |
| 4,345,510 | 8/1982 | Sterrett | 98/114 X |
| 4,493,456 | 1/1985 | Sarazen, Jr. et al. | 236/49 |
| 4,587,892 | 5/1986 | Witten et al. | 98/29 |

*Primary Examiner*—Albert J. Makay
*Assistant Examiner*—Steven E. Warner
*Attorney, Agent, or Firm*—Dority & Manning

[57] ABSTRACT

The housing of a foundation ventilator has the usual front screen to protect the louvres within the housing, but the screen is part of a support frame used to mount the ventilator in an opening in a foundation wall. The support frame is frictionally retained in the opening by threaded bolts which can be easily loosened to gain access to the interior of the housing for cleaning or repair. It is not necessary to remove the ventilator from the wall. Similarly, if the support frame is damaged, it can be replaced without the expense of replacing the entire ventilator. The support frame has a connecting flange which seats within an extension of the housing to prevent relative lateral movement. Interlocking tabs and detents releasably attach the housing to the support frame with the screen in the support frame covering the front of the housing.

5 Claims, 8 Drawing Figures

FIG. 5
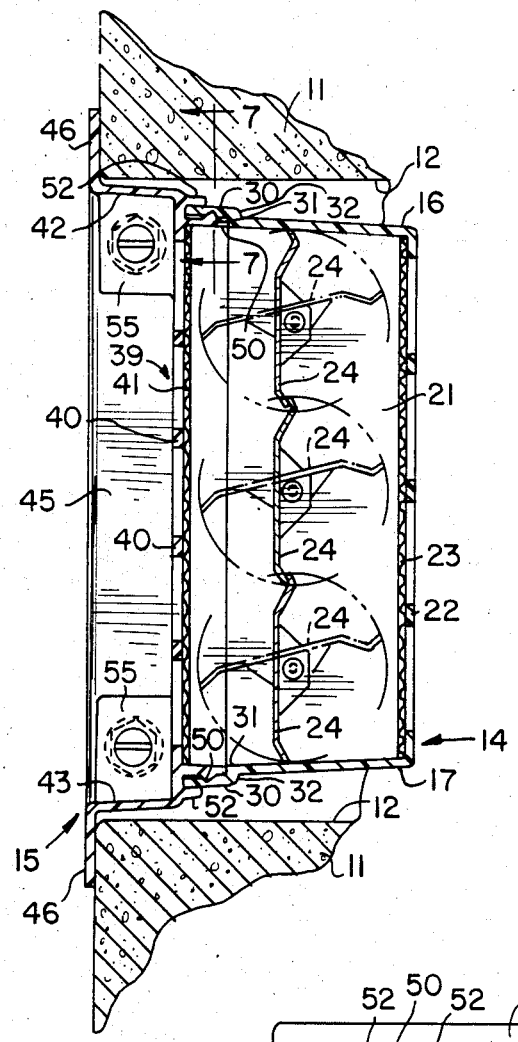
FIG. 6
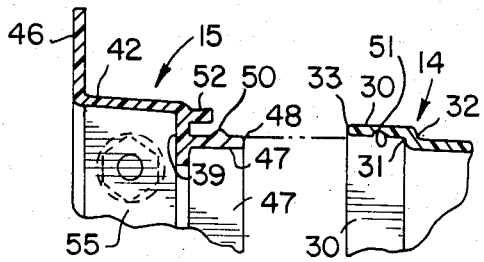
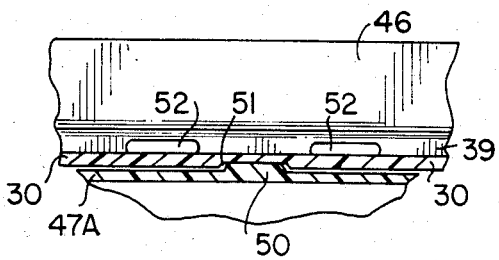
FIG. 7
FIG. 8
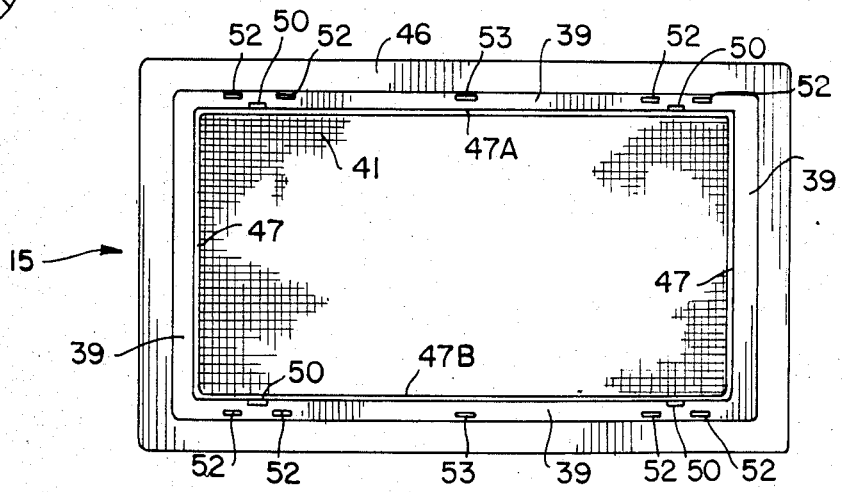

HOUSING FOR FOUNDATION VENTILATOR

BACKGROUND OF THE INVENTION

This invention relates to foundation ventilators of the type used to provide ventilation in crawl spaces beneath houses. It is customary to open the foundation ventilators in the spring and close them in the fall to ensure proper ventilation during the warmer months while minimizing heat loss during the colder months. Thermostatically controlled ventilators are used to open and close the ventilators automatically without attention.

The installation of foundation ventilators in masonry walls once required the skill of a craftsman. Recently, efforts have been made to provide foundation ventilators of a construction enabling the average homeowner to place the foundation ventilator an existing opening in a foundation wall. See, for example, U.S. Pat. No. 4,274,330 issued June 23, 1981 to Alvin E. Witten, et al. for VENTILATOR AND MOUNTING FRAME ASSEMBLY. According to Witten, the assembly of the ventilator in an opening in a foundation wall is a two step process. First, a rectangular hollow frame is assembled in the opening with specially designed fasteners and clamps, and the ventilator is then assembled within the hollow frame. U.S. Pat. No. 4,175,480 issued Nov. 27, 1979 to Dennis A. Beam et al. for WALL VENTILATOR CONSTRUCTION discloses a ventilator housing and frame which are connected together by the same bolts used to fasten the ventilator in an opening in a foundation wall. In both Witten and Beam the mounting frame is a hollow rectangle and the ventilator housing is enclosed with a screen on the front and rear. It is necessary, according to the prior art as represented by Witten and Beam, to remove the ventilator housing from the opening in the foundation wall and/or to remove the rear wall of the housing in order to service the louvers or operating mechanism within the ventilator housing. Such servicing is periodically necessary to remove debris and insects which accumulate within the ventilator housing and tend to interfere with the automatic functioning of thermostatically controlled foundation ventilators.

SUMMARY OF THE INVENTION

The housing of applicant's foundation ventilator is formed with the top and bottom walls and rear wall as an integral unit. The top and bottom and end walls are solid while the rear wall is a plastic grid covered with an insect repelling screen. The front of the ventilator housing is open. Thermostatically actuated louvers are pivotally mounted within the housing and access to the louvers for servicing and cleaning is made through the front of the ventilator. A support frame is covered with a plastic grid and insect repelling screen which fits tightly over the front of the housing to protect its contents while permitting free air flow through the housing. The support frame is registrable with an extension of the housing and the frame and housing are releasably interlocked before the housing is mounted in an opening in a foundation wall. When it is desired to gain access to the louvers within the housing it is only necessary to remove the support frame from the opening in the foundation wall, which automatically opens the front of the housing, and access to the louvers can be obtained through the front of the housing without removing the housing from the opening. Opposite sides of the mounting frame are fitted with nuts and bolts for frictional attachment to the edges of an opening.

BRIEF DESCRIPTION OF THE DRAWINGS

FIG. 5 is a sectional view taken substantially along the line 5—5 in FIG. 2;

FIG. 6 is a sectional view taken substantially along the line 6—6 in FIG. 3;

FIG. 7 is a sectional view taken substantially along the line 7—7 in FIG. 5; and FIG. 8 is a rear elevation of the support frame.

DETAILED DESCRIPTION OF THE INVENTION

Figure 1:
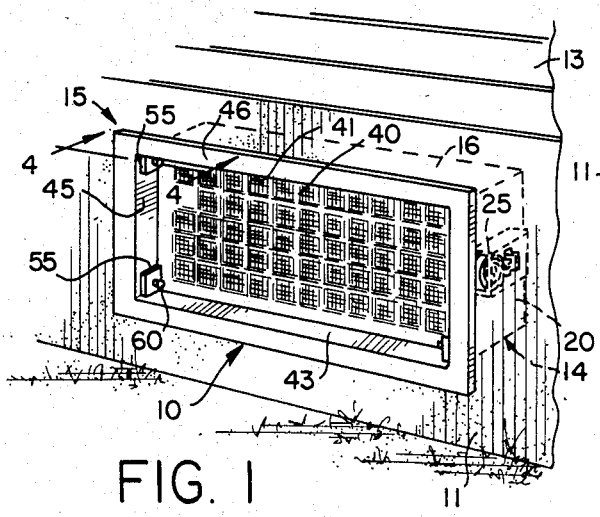
FIG. 1 is a perspective view showing the mounting frame spanning a foundation wall and showing the ventilator housing in dotted lines.

Referring to FIGS. 1 and 5, a foundation ventilator broadly indicated at 10 is mounted in a foundation wall 11 of a building. The ventilator 10 may be installed during initial construction of the building or it may be subsequently added to the building. In either event, an opening 12 is formed in the foundation wall 11 to receive the ventilator. Openings having a vertical dimension of 8 inches and a horizontal dimension of 16 inches are commonly used in domestic buildings and the ventilator of this invention will be described as intended for use in openings of that size. It is to be understood, however, that the ventilator may be made to fit any size opening within the scope of the invention.

The opening 12 in the foundation wall 11 provides communication between the atmosphere outside of the building and a crawl space or enclosed area behind the foundation wall 11 and beneath a building 13. It is the purpose of the ventilator to close the opening 12 during the cold months and to open the opening 12 during the warmer months so as to provide ventilation in the crawl space and prevent the formation of mold, wood rot, mildew, and musty odors beneath the building. Openings 12 are spaced from each other above ground level at distances prescribed by local codes, and a ventilator such as indicated at 10 is placed in each such opening 12.

The ventilator 10 includes a housing 14 and a mounting frame 15. The housing and support frame are preferably made from heavy duty plastic and each is preferably molded as an integral unit. The housing 14 has top and bottom walls 16 and 17 extending horizontally in use and end walls 20 and 21 extending vertically in use. A rear wall defined by a plastic grid 22 is formed integral with the top and bottom walls 16, 17 and the end walls 20, 21. A screen 23 having a mesh size comparable to that of ordinary household window screen is fixed to the inner surface of the grid 22 on the rear of housing 14.

A plurality of louvers 24 are pivotally connected to the end walls 20 and 21 and are movable between the closed solid line position and the open dotted line position of FIG. 5 responsive to changes in temperature sensed by a bimetalic thermostat element 25 operatively connected as at 26 to the louvers 24.

An annular or peripheral extension 30 extends forwardly from top and bottom 16, 17, and end walls 20, 21 of the housing 14. The extension 30 is outwardly offset from each of the walls 16, 17 and 20, 21 to define inner shoulders 31 and outer shoulders 32 at the juncture of the extension 30 with the body portion of the housing defined by walls 16, 17, 20, and 21.

The mounting frame 15 includes a rear wall 39 partially defined by an open grid 40 covered with screen 41 shaped and dimensioned to cover the front of the housing 16 when assembled as shown in the drawings. The mounting frame 15 also includes upper and lower walls 42, 43, and end walls 44, 45. A peripheral mounting flange 46 extends perpendicularly from the walls 42, 43, 44 and 45 of the mounting flange 15 in overlying relation to the edges of the opening 12.

The rear wall 39 of support frame 15 extends outwardly in all directions beyond the grid 40 and screen 41 and an annular or peripheral connecting flange 47 shaped and dimensioned to fit within the extension 30 of housing 14 extends from the rear wall 39 of mounting frame 15 toward the houisng 14.

As perhaps best seen in the exploded view of FIG. 6 the free edge 48 of connecting flange 47 seats against the shoulder 31 of the extension 30 when assembled, and is held in that position by bosses 50 protruding upwardly from upper flange 47A and downwardly from lower flange 47B registered with and seated in detents 51 in the extension 30. The free edge 33 of extension 30 seats against the proximal surface of the rear wall 39 of mounting frame 15 between the connecting flange 47 and positioning tab 52 in FIG. 6. Additional reinforcement is provided by centrally disposed positioning tabs 53 protruding from the rear wall 39 of support frame 15 and overlapping the extension 30 when assembled (FIGS. 2 and 3).

Figure 2:
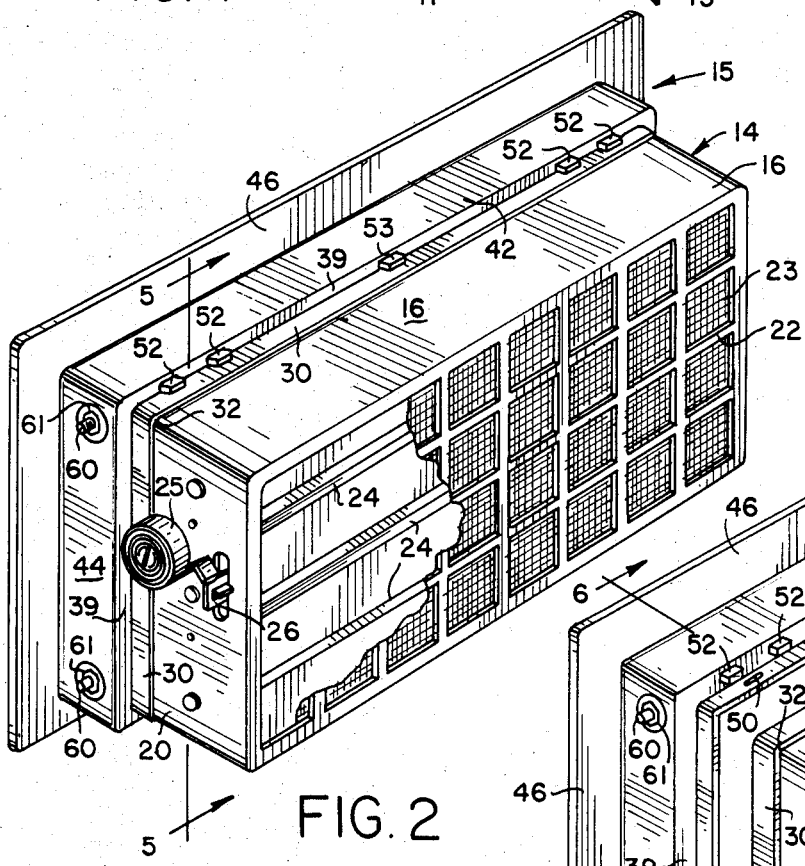
FIG. 2 is a perspective view looking at the top, one side and rear of the ventilator housing with part of the rear wall being broken away to illustrate the louvers within the housing.
Figure 3:
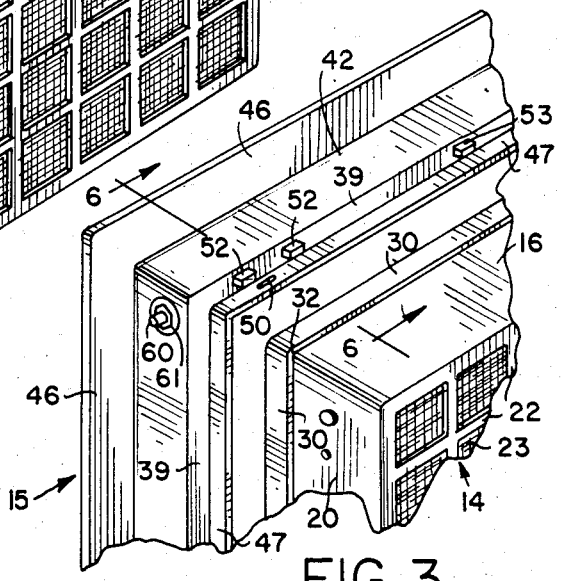
FIG. 3 is a fragmentary perspective view similar to FIG. 2 but showing the support frame and housing in exploded relation to illustrate the attachment of the mounting frame to an extension of the housing.

FIG. 2 illustrates the assembled relation of the support frame 15 and housing 14, and after the ventilator has been assembled it is ready to be positioned in an opening such as indicated at 12.

Figure 4:
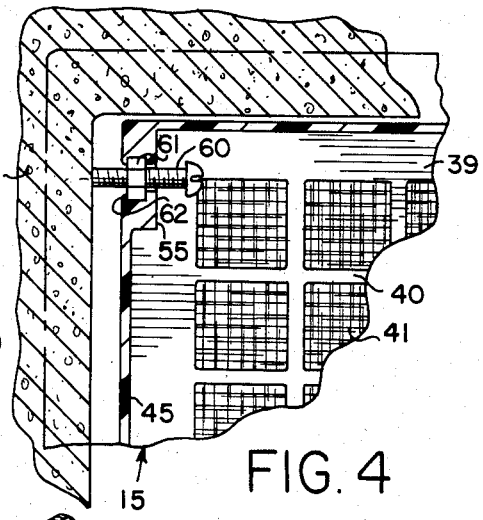
FIG. 4 is a sectional view taken substantially along the line 4—4 in FIG. 1.

Enthickened shoulders 55 are formed near the top and bottom corners of the end walls 44 and 45 of mounting flange 15 and have openings to receive conventionally by threaded bolts 60 (FIG. 4) to be used in installing the ventilators in masonry walls. Each of the shoulders 55 also has a hexagonally shaped recess surrounding the opening to receive a conventionally threaded nut. The ventilators are equipped with the threaded nuts and bolts at the time of manufacture, the nuts 61 being retained in their respective recesses by inwardly turned lips 62 overlapping respective nuts 61.

The user receives the ventilator with the embedded nuts 61 and. threaded bolts 60. The ventilator may be readily installed in an existing opening by merely tightening the bolts 60 in corresponding nuts 61 against the masonry defining the ends of the opening 12. As the ends of the bolts bear against opposed ends of the opening 12, the ventilator is fictionally retained in the opening with the flange 46 extending over the edges of the opening to provide an airtight fit. The support frame 14 may be easily removed by loosening the bolts 60 and lifting the support frame 15 and its rear wall 39 from the opening to expose the louvers and working mechanism of the ventilator for cleaning and repair, as required.

One advantage of the present invention is that it is possible to replace the mounting flange with a new one without having the expense of replacing the entire ventilator. Another advantage is the reinforcement provided by the tightly interlocking connecting flange 47 and extension 30 on the housing 14.

Although specific terms have been used in describing the invention, they are used in a generic sense only and not for purposes of limitation.

I claim:

1. A housing for a foundation ventilator, said housing having top and bottom walls extending substantially parallel to one another and opposed end walls extending substantially parallel to one another, a plurality of louvers extending between and pivotally mounted in the opposed end walls and a rear wall defined by a grid and covered with mesh screen, said housing having an open front, an annular extension of the housing extending about its open front from and substantially parallel to said top and bottom and opposed end walls, said annular extension protruding laterally and forwardly from the housing, a support frame adapted for receipt in an opening of a foundation wall including a grid covered with protective screen, and said support frame including a peripheral connecting flange having top and bottom flange walls extending substantially parallel to one another and opposed end walls extending substantially parallel to one another, the top and bottom and opposed end flange walls extending rearwardly beyond the grid of the support frame shaped and dimensioned to fit within the annular extension of the housing, and cooperating attachment means defined integrally with both said housing and said support frame for releasably interlocking said annular extension of said housing with the peripheral connecting flange of the support frame for enclosing the front of the housing and protecting the louver mechanism within the housing.

2. A structure according to claim 1 wherein said cooperating attachment means includes registrable bosses provided on the peripheral connecting flange of the support frame and detents provided on the annular extension of the housing for registering with said bosses to frictionally interlock the support frame with the housing.

3. A structure according to claim 2 wherein positioning tabs extend toward the housing from the support frame in spaced parallel relation to the peripheral connecting flange, and the free edge of the annular extension is positioned between the peripheral connecting flange and the positioning tabs to prevent lateral movement of the housing relative to the support frame when assembled.

4. A foundation ventilator for receipt in an opening of a foundation wall, the foundation ventilator comprising:

a support frame adapted for receipt with an opening of a foundation wall, said support frame having a substantially rectangular peripheral connecting flange defining a rectangular opening in said support frame;

said peripheral connecting flange having a top flange wall and a bottom flange wall extending substantially parallel to one another and opposed end flange walls extending substantially parallel to one another;

a housing having a substantially rectangular peripheral extension defining a substantially rectangular housing opening;

said peripheral extension being receivable about said peripheral connecting flange of said support frame and having a top wall and a bottom wall extending substantially parallel to one another and opposed end walls extending substantially parallel to one another;

a plurality of louvers extending between and pivotally mounted in said opposed end walls of said housing;

a rear wall defined in said housing by a grid, said grid being covered with mesh screen; and said peripheral connecting flange of said support frame and said peripheral extension of said housing each defining a plurality of integral registrable means for releasably interlocking said peripheral connecting flange and said peripheral extension to one another.

5. A foundation ventilator as defined in claim 4, wherein said plurality of integral registrable means includes said peripheral connecting flange of said supporting flange defining bosses thereon and said peripheral extension defining detents therein for engagingly receiving said bosses.

* * * * *